United States Patent [19]

Wilson et al.

[11] Patent Number: 4,822,106

[45] Date of Patent: Apr. 18, 1989

[54] GOLF BALL DREDGE

[76] Inventors: Steven M. Wilson, 284 Oak Ct.; Richard D. Mason, 330 N. Putney Way, both of Severna Park, Md. 21146

[21] Appl. No.: 130,609

[22] Filed: Dec. 9, 1987

[51] Int. Cl.[4] ..... E02F 7/06; E02F 3/88

[52] U.S. Cl. ..... 299/9; 37/55; 37/57; 37/61; 37/DIG. 8; 209/273; 209/235; 209/677; 209/906

[58] Field of Search ..... 37/54, 55, 57, 58, 61, 37/62, 63, DIG. 8; 210/242.1; 209/273, 235, 675, 677, 906, 421; 299/7, 8, 9; 56/13.1, 31, 334, 336, 328.1; 294/19.2

[56] References Cited

U.S. PATENT DOCUMENTS

| | | | |
|---|---|---|---|
| 1,097,722 | 5/1914 | Lake | 37/55 |
| 2,204,584 | 6/1940 | Flower | 37/55 X |
| 2,217,412 | 10/1940 | Jackson et al. | 37/55 |
| 3,213,807 | 10/1965 | Ramsden et al. | 37/61 X |
| 3,535,801 | 10/1970 | Richter | 37/61 |
| 3,808,785 | 5/1974 | Petcher | 56/13.1 X |
| 3,819,049 | 6/1974 | Koerner et al. | 209/250 |
| 3,972,566 | 8/1976 | Brockett, III et al. | 37/DIG. 8 |
| 4,070,061 | 1/1978 | Obolensky | 37/DIG. 8 |
| 4,289,355 | 9/1981 | Rose | 299/9 |
| 4,346,937 | 8/1982 | Latimer et al. | 37/DIG. 8 |
| 4,368,923 | 1/1983 | Handa et al. | 37/DIG. 8 |
| 4,635,987 | 1/1987 | Hurtgam | 294/19.2 |

FOREIGN PATENT DOCUMENTS

| | | | |
|---|---|---|---|
| 872662 | 10/1981 | U.S.S.R. | 37/54 |
| 1076541 | 2/1984 | U.S.S.R. | 37/58 |
| 1090807 | 5/1984 | U.S.S.R. | 37/58 |

*Primary Examiner*—Clifford D. Crowder
*Attorney, Agent, or Firm*—Charles W. Helzer

[57] ABSTRACT

A golf ball dredge which comprises a shallow draft, buoyant support vessel in the form of a pontoon boat that provides a floating platform from which the dredging apparatus is supported. The pontoon boat has a small outboard motor mounted at its bow for providing a means for propulsion and steering of the boat. A relatively high pressure, gasoline powered, centrifugal water pump is mounted on the pontoon boat with its suction intake located below the water level. The pump provides a high pressure water outlet discharge that is supplied through eductor tubes into the inlet end of a bottom suction intake piping system. The bottom suction intake piping system also is supported on the pontoon boat with its inlet end submerged below the surface of the water to a suitable depth for lightly contacting the bottom of the waterhole. The high pressure water discharge from the pump is supplied through the educator tubes to the inlet end of the suction intake piping system for creating a suction action that draws water and any entrained solids such as golf balls into the suction intake piping system. The suction intake piping system discharges under relatively high pressure water and any entrained solids into the inlet end of an automatically operable golf ball separator means supported on the pontoon boat for automatically separating out golf balls from liquid and other entrained solids contained in the suction intake piping system discharge without requiring the need for human intervention in the separating procedure.

20 Claims, 2 Drawing Sheets

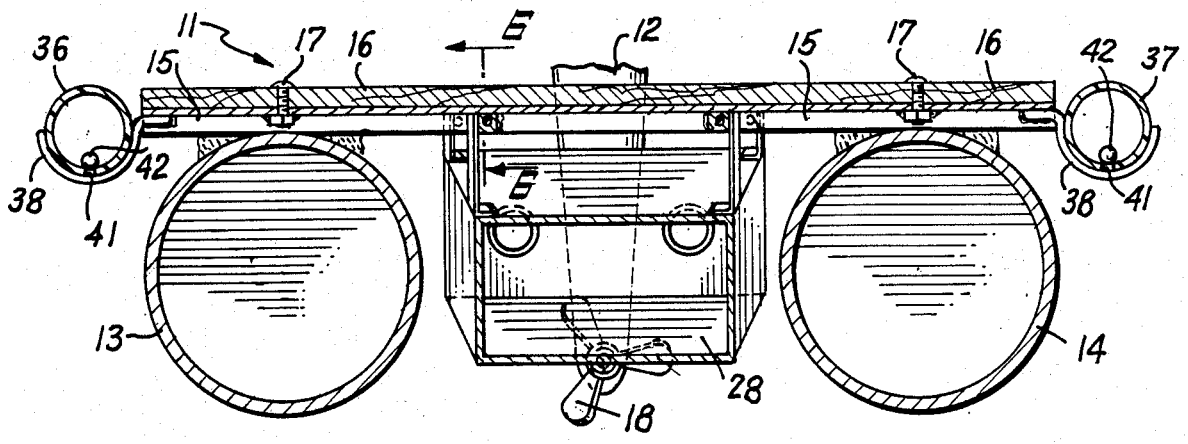
Fig. 3
Fig. 4
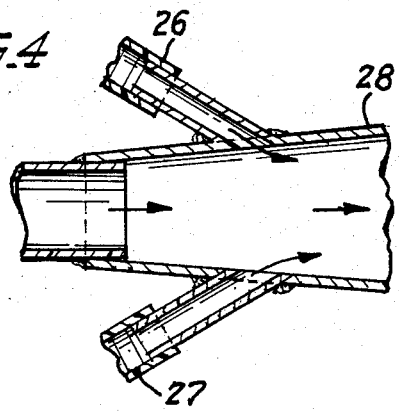
Fig. 5
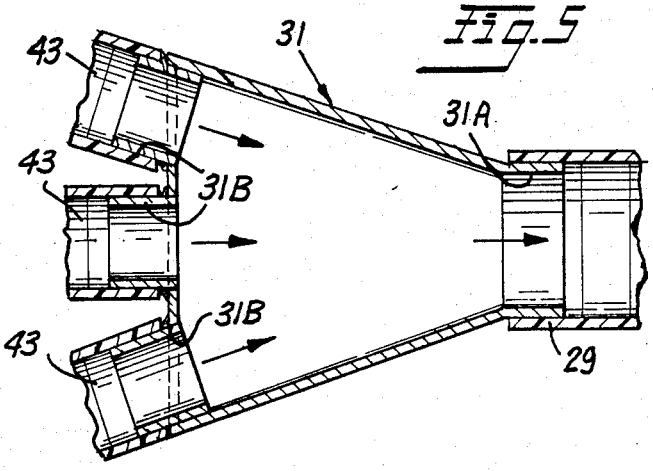
Fig. 6
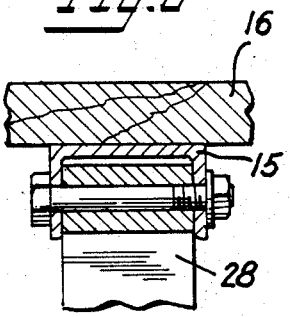
Fig. 7
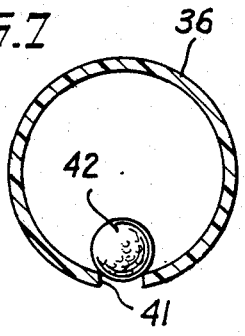
Fig. 8
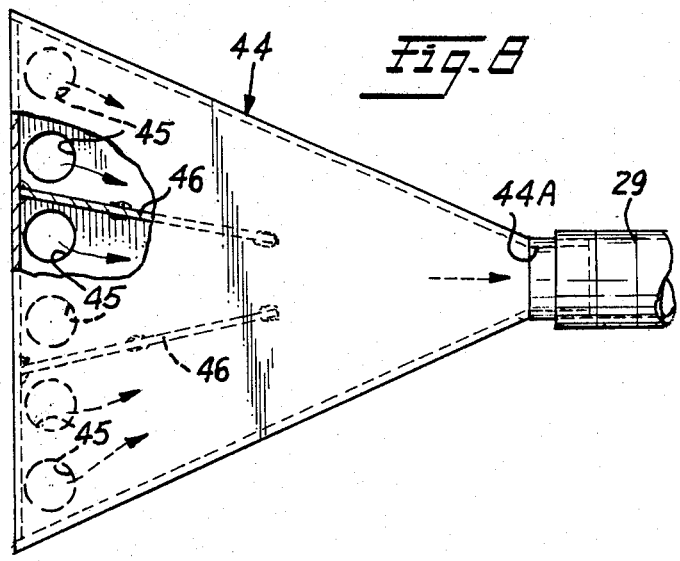

GOLF BALL DREDGE

FIELD OF THE INVENTION

This invention relates to a small dredge and in particular to a small dredge mounted on a shallow draft boat for use in dredging golf balls from ponds, lakes, pools and the like used as waterholes on golf courses.

BACKGROUND PRIOR ART PROBLEM

During the past several years golf ball manufacturers have encased the latest designed golf balls in water impervious covers. As a result, it does not age such balls or deteriorate their characteristics if they happen to lie under water for sustained periods of time. As a consequence, the small water holes in the form of ponds, lakes, pools and the like found on the nation's golf courses have become depositories of valuable collections of such watertight encased golf balls.

In order to recover golf balls which have been collected in the waterholes, a small industry has developed which employs professional swimmers and divers who may or may not use SCUBA (self-contained underwater breathing apparatus) equipment. Needless to say, this technique of recovery involves the swimmers and divers to swim and walk around in lakes which may have tin cans, broken glass, snakes, alligators, etc., which present a hazard to the golf ball retrievers. In addition, often such lakes have sandy or muddy bottoms so that only a small amount of retrieval activity makes the water become quite murky and difficult to see through to locate the submerged balls, particularly those in deeper water. As a result, this manual method of recovery involving swimmers and divers, results in very low yield of retrieved balls, something on the order of 10%, if that.

In order to provide an improved apparatus and technique for recovery of lost golf balls in water holes on golf courses, the present invention was devised.

SUMMARY OF INVENTION

It is therefore a principle object of the present invention to provide a small, shallow draft golf ball dredge designed specifically for use in the dredging of golf balls from ponds, lakes, pools and other waterholes located on golf courses.

In practicing the invention a golf ball dredge is provided which comprises a shallow draft, buoyant vessel in the form of a pontoon boat having propulsion means comprising an outboard motor mounted on its bow for moving the vessel through shallow water and steering it around the waterhole. A gasoline engine driven, relatively high pressure, water pump is supported on the shallow draft vessel with its suction intake located below the water level and provides a high pressure outlet water discharge. An educator tube is mounted on the vessel with its inlet end supplied from the high pressure outlet water discharge of the high pressure water pump and with its discharge end connected to a bottom suction intake piping system. The bottom suction intake piping system also is mounted on the vessel with its inlet end submerged below the surface of the water to a suitable depth for lightly contacting the bottom of the lake, pool, pond, or the like. The eductor tube has its discharge end connected to the suction intake piping system near the inlet end thereof for producing a suction action that draws water and any entrained solids into the suction intake piping system and discharges it out of the discharge end of the piping system under increased pressure due to eductor action produced by the high pressure water discharge supplied from the pump. The golf ball dredge is completed by an automatically operable golf ball separator means supported on the vessel and having the discharge end of the suction intake piping system connected to it for automatically separating out golf balls from the liquid and other entrained solids contained in the suction intake piping system discharge without the need for human intervention in the golf ball separating procedure.

BRIEF DESCRIPTION OF DRAWINGS

These and other objects, features and many of the attendant advantages of this invention will be appreciated more readily as the same becomes better understood from a reading of the following detailed description, when considered in connection with the accompanying drawings, wherein like parts in each of the several figures are identified by the same reference characters, and wherein:

FIG. 3 is an enlarged transverse vertical sectional view taken on line 3—3 of FIG. 2 and showing certain details of construction of the golf ball dredge;

FIG. 4 is an enlarged fragmentary, horizontal sectional view, taken on line 4—4 of FIG. 2 and showing the details of construction of the eductor tube connection to the bottom suction intake piping system;

FIG. 5 is a enlarged fragmentary horizontal sectional view, taken along line 5—5 of FIG. 2 and showing the details of construction of one embodiment of a nozzle-like suction pick-up head used with the golf ball dredge on waterholes with a hard bottom of sand or rock;

FIG. 6 is an enlarged fragmentary vertical sectional view, taken through line 6—6 of FIG. 3, and showing details of construction of one of the hangers used to support the fixed ducting portion of the bottom suction intake piping system at their points of connection to the pontoon boat;

FIG. 7 is an enlarged transverse sectional view taken through one of the golf ball separator tubes and showing a retrieved golf ball therein; and FIG. 8 is a plan view, partly in section, of an alternative embodiment of a nozzle-like suction pick-up head for use with soft or muddy bottoms.

BEST MODE OF PRACTICING THE INVENTION

Figure 1:
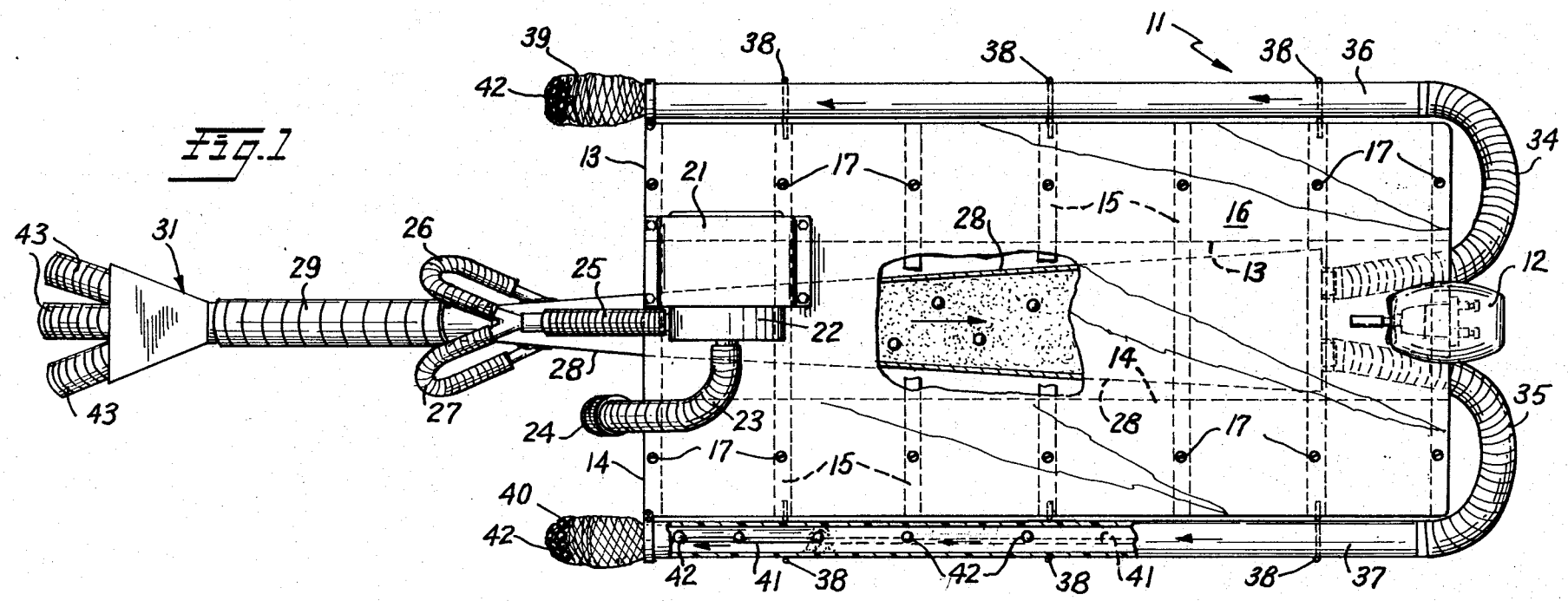
FIG. 1 is a plan view, partly in section, of a novel golf ball dredge constructed according to the present invention.
Figure 2:
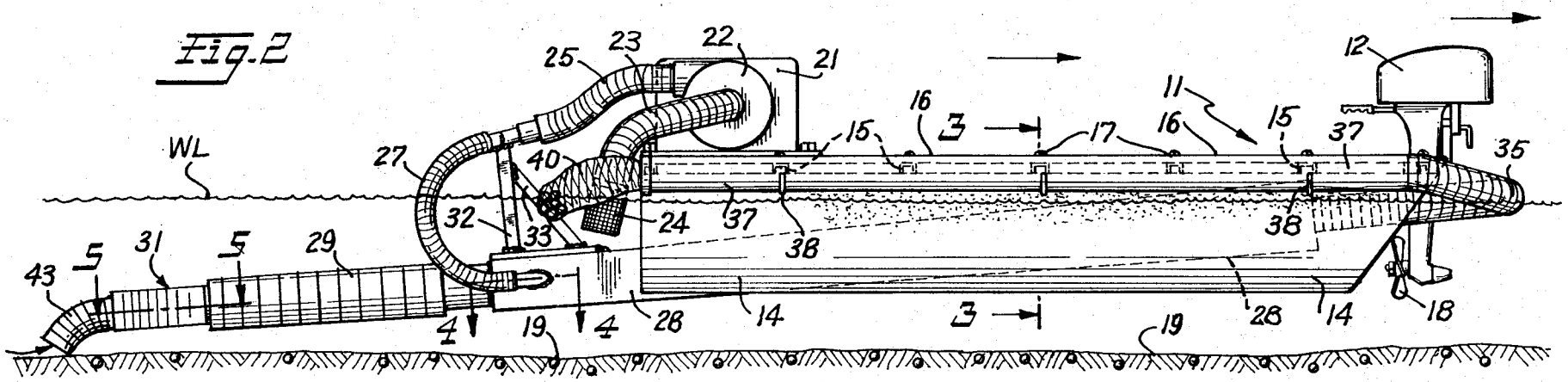
FIG. 2 is a side elevational view of the golf ball dredge shown in FIG. 1.

FIG. 1 is a top plan view, partly in section, and FIG. 2 is a side elevational view of a golf ball dredge according to the invention. The golf ball dredge is comprised by a shallow draft buoyant vessel in the form of a pontoon boat having an outboard motor 12 mounted on its bow for moving and steering the vessel through water. The pontoon boat 11 comprises a pair of spaced-apart, cylindrical, lightweight aluminum pontoons 13 and 14 of conventional construction. In the embodiment of the invention herein disclosed, the pontoons 13 and 14 are about 12 feet long and 22 inches in diameter, and are connected together by a series of parallel, 6 foot long, 2 inch by 2 inch aluminum channel members 15 of U-shaped cross section that are secured between the pontoons by braising, welding or otherwise in order to form a relatively rigid, floating platform. A deck 16 of ¾ inch thick marine plywood 6 feet by 12 feet in dimension is secured to the cross channel members 15 by suitable nut and bolt fasteners 17 as best seen in FIG. 3 of the drawings. The outboard motor 12 is mounted on the plywood deck 16 substantially in the middle of the bow of the boat with its propeller 18 positioned midway between the pontoons 13 and 14. By this construction, the propeller 18 is protected and prevented by the pontoons from striking the bottom 19 of a body of water on which the dredge is floated. The surface of the body of water is depicted by the waterline WL as shown in FIG. 2 of the drawings. The outboard motor 12 may be a 10 horsepower outboard motor of conventional, commercially available construction such as a Johnson or Evinrude.

The golf ball dredge is further comprised by a bottom water and entrained solids suction system that is powered by a gasoline driven, air cooled, 1600 cc Volkswagen engine 21. Engine 21 is directly coupled to a lightweight, aluminum body, centrifugal water pump having a maximum capacity of 1000 gallons per minute delivered at 50 psi gauge. The pump 22 has its water intake supplied through a flexible water suction intake hose 23 of about 5 inch diameter whose open end is closed by a fine mesh screen 24. The water suction intake hose 23 is designed to be trailed over the after end of the pontoon boat with the screened intake open end 24 of the tube maintained below the water level WL of the water in which the boat is floating. High pressure water produced by pump 22 is supplied through a flexible, high pressure water discharge tube 25 of 4 inch diameter to a pair of flexible, 2 inch eductor tubes 26 and 27 that branch outwardly from the end of the high pressure water discharge tube 25.

The bottom water and entrained solids suction system of the golf ball dredge further includes a bottom suction intake piping system, part of which is shown generally at 28 in FIG. 2 and in the partial sectional opening in FIG. 1. The bottom suction intake piping system 28 is principally constituted by a fixed aluminum ducting arrangement made of flat, interconnected plates of aluminum physically supported between the two pontoons 13 and 14 of the pontoon boat 11 in the manner shown in FIG. 6 of the drawings. This fixed portion 28 of the bottom suction intake piping system extends substantially along the full length of the boat from the stern to the bow and is angularly oriented relative to the deck 16 (as well as to the waterline WL) so that the back or stern end of the ducting arrangement fits lower in the water than does the bow or forward end as best seen in FIG. 2 of the drawings. The after or stern end of the bottom suction intake piping system is comprised by a relatively large diameter (8 inch) PVC or aluminum flexible intake tube 29 secured to ducting portion 28 and having an enlarged, triangular-shaped, nozzle-like, relatively flat suction pick-up head 31 supported at its remote or distal end and which rides along the bottom 19 to suck up water and any golf balls that might be lying on the bottom as explained hereinafter.

As best seen in FIGS. 1 and 2, considered in conjunction with FIG. 4 of the drawings, the after or stern end of ducting arrangement 28 that comprises the main part of the bottom suction intake piping system, includes a set of welded, aluminum support arms 32 and 33 formed by U-shaped channel members which support a hose clamp for holding the eductor tubes 25, 26 and 27 in place relative to the discharge outlet from pump 22. As best shown in FIG. 4 of the drawings, the eductor tubes 26 and 27 which extend backwardly from the larger diameter eductor tube 25 and the discharge outlet of pump 22 to the point of support of the upright support arms 32 and 33 and then curve forwardly to enter opposite sides of the fixed ducting portion 28 of the bottom suction intake piping system 28. As best shown in FIG. 4, the eductor tubes 26 and 27 enter the fixed ducting portion 28 at a slight angle relative to the center axis of the bottom intake suction tube 29 through which water and any entrained solids including golf balls are drawn by the eductor suction action produced by the high pressure jets entering the bottom suction fixed ducting portion 28 via the angularly attached eductor tubes 26 and 27. The suction action created by the eductor tubes 26 and 27 at their juncture with the fixed ducting portion 28 is directed out through the enlarged diameter flexible tube 29 and nozzle-like suction pick-up head 31 to the bottom where it will pick up and entrain in a mixed flow of water and solids, objects as large as a golf ball and supply them under liquid pressure forwardly in the manner indicated by the arrows in FIG. 4.

At the front or bow end of pontoon boat 11 the upwardly angled bottom suction intake piping system ducting 28 is closed by an end baffle (not shown) having a large diameter (6 inch), circular opening on each of the sides thereof. The respective, enlarged circular openings are connected to inlet ends of respective, large diameter (6 inch), flexible conduits 34 and 35, respectively. Flexible conduits 34 and 35 extend forwardly from the front end of the boat and around each of the sides thereof and terminate at the inputs to respective automatic golf ball separator means 36 and 37. The automatic golf ball separator means function automatically to separate golf balls picked up by the dredge without the need for human intervention in the golf ball separating procedure.

The automatic golf ball separator means is comprised of a golf ball passageway means supplying a golf ball differentiating means which in turn delivers golf balls to a golf ball collecting means. The golf ball passageway means comprise a 6 inch diameter polyvinylchloride (PVC) pipe having a length about equal to that of the pontoon boat and removably secured to each side of the deck 16 by suitable U-shaped clamps shown at 38 in FIGS. 1 and 3. The golf ball passageway cubes 36, 37 each have a longitudinally extending slot 41 about 1¼ inch wide formed along the entire length of their underside closest to the water as best shown in FIG. 7 of the drawings which form the golf ball differentiating means. The open after end of the golf ball passageway tubes 36 and 37 terminate in respective mesh bags 39 and 40 that comprise golf ball collection and containing means for collecting and containing golf balls 42 which are rolled down the length of the tubes 36 and 37 by the pressure of the water forced into the forward end of tubes 36 and 37 by pump 22 via flexible coupling tubes 34, 35, the system 28 and eductor tubes 26 and 27. Because the golf balls have a diameter of 1 5/8 inch, they will not drop through the 1¼ inch slots as shown at 42 in FIG. 7, but any mud and other entrained solids as well as water will be washed out through the slots 41 without requiring human intervention in the process.

It is believed obvious to one of skill in the art, that if desired a slight tilt or downward angle could be provided for the golf ball separator tubes 36 and 37 so that the tubes angle downwardly towards the water at the rear or after end of the boat as the tubes extend from the forward to the rear end of the boat. If so mounted, gravity also will act upon the golf balls to cause them to travel rearwardly towards the collection mesh bags 39 and 40 in addition to the force of the water jet provided by the pump 22 via the bottom suction intake piping system.

FIG. 5 is an enlarged, fragmentary, horizontal sectional view of the nozzle-like pick up head 31 taken along line 5—5 of FIG. 2. The nozzle-like pick up head 31 forms an enlarged, triangular-shaped, relatively flat suction head having one end 31A connected to the large 8 inch diameter, flexible tube 29 that is connected to the suction intake ducting 28 as described earlier with respect to FIGS. 1 and 2. The enlarged, triangular shaped, nozzle-like suction head 31 has a plurality of openings 31B formed in the end surface thereof to which relatively short, smaller 6 inch diameter, finger-like flexible, hollow hoses 43 are secured so that they extend across the width of the base of the triangular-shaped suction head 31 like the fingers of the hand of a human being. The smaller diameter, flexible tubes 43 are bent downwardly as best seen in FIG. 2 so as to engage the bottom surface 19 of the like, pond, pool or other waterway on which the dredge is being used. The width of the base of the triangular-shaped suction head shown at 31 in FIG. 5 is about 3 feet and is designed as a multi-purpose suction head for use on hard bottoms such as sand or clay or mud bottoms which have obstructions therein such as stumps, rocks, etc. The small diameter, flexible, finger-like hoses 43 are about 6 inches in diameter and approximately 1 foot in length so they act like fingers as they are dragged over the bottom for sucking up golf balls along with the water and other entrained solids through the bottom suction intake piping system further comprised by elements 31, 29, 28, 34 and 35.

FIG. 8 is a plan view, partly in section, illustrating an alternative design for the suction pick up head. The suction pick up head shown in FIG. 8 again employs an enlarged, relatively flat triangular-shaped baffled chamber 44 having its apex-like inlet end 44A connected to the enlarged diameter, flexible inlet tube 29 supplying the fixed ducting portion 28 bottom suction intake piping system. The enlarged, flattened, triangular-shaped chamber 44 has a plurality of openings shown at 45 arrayed along its bottom surface near the base end of the triangular-shaped chamber. The bottom surface in which the openings 45 are formed is designed to be dragged along a soft or muddy bottom of a lake, pond, pool or other waterhole. Baffles shown at 46 are mounted within the chamber 44 so as to assure equal distribution of the suction produced by eductor tubes 26 and 27 in the bottom suction intake piping system via the large diameter coupling tube 29. The nozzle-like suction head shown in FIG. 8 is dimensioned such that the base of the triangular-shaped chamber 44 has a dimension of about 4 feet with 4 inch diameter opening 45 and the spacing between the bottom and top surfaces of the triangular-shaped chamber being about 10 inches. In comparison, the multi-purpose nozzle-like suction head 31 shown in FIG. 5 measures only about 3 feet across the base, but the spacing between the top and bottom surfaces of the triangular-shaped chamber 31 is about the same as that of chamber 44.

In operation, the pontoon boat together with pump 22 and all of its interconnected bottom suction intake piping system ducting and tubing is carried on a two wheel-platform type trailer that can be trailed behind a small pick up truck, car or the like. To facilitate this operation, the overall weight of the Golf Ball Dredge is designed to be about 1000 pounds. Upon arrival at a particular waterhole on a golf course whose waterholes are to be dredged for golf balls, the trailer with the pontoon boat upon it can be backed into the edge of the waterhole (if possible) and the pontoon boat 11 slid off the trailer into the water in the usual manner of launching small boats. If desired, either a manual or electric winch can be employed to facilitate launching and replacement of the boat back onto the trailer. At this point, two operators climb on the pontoon boat, one to run the outboard motor 12 at a desired dredging speed of up to 30 feet per minute and of course steer the boat in a predesigned pattern so that comprehensive coverage of the entire bottom of the pond or other waterhole is covered by the dredge. The speed of the boat adjusted to cover approximately half a foot per second and this can be achieved with a suitable 10 horsepower outboard motor 12 of conventional, commercially available construction such as an Evinrude, Johnson, etc.

The second operator is in charge of air cooled, gasoline driven engine 21 which directly drives the centrifugal pump 22 to provide a suitable flow rate through the eductor tubes 26–27 to product a desired suction action dependent principally upon the depth of the water in which the dredge is being operated. The second operator also adjusts depth at which the suction take up head 31, or alternatively 44 as shown in FIG. 8, is set as the boat moves through the water. The preferred method of adjusting this depth is by changing the length of the large diameter, flexible coupling tube 29 interconnecting the nozzle-like suction head 31 with the fixed ducting portion system supported on the pontoon boat. The coupling tube 29 also can be bent downwardly so as to cause the finger-like smaller diameter flexible tubes 43 of suction head 31 to extend deeper into the water in order to slightly engage the bottom surface 19 of the waterhole. If desired, the fixed ducting portion 28 of the suction system can be supported in such a manner that it can be raised or lowered at the after or stern end of the pontoon boat so as to allow the dredge to work in deeper waters. A suitable adjustable hanger support structure for this purpose has not been described since it's construction is believed to be obvious to one skilled in the art of support structures. Further, experience has proven that an adequate range of water depths can be obtained by the first mentioned technique of changing the length of the coupling tube 29 and/or bending it slightly downward to extend the pick up fingers 43 into deeper water. In addition to controlling the speed of the centrifugal pump 22 and the setting of the nozzle-like suction head 41 or 44, the second operator also is in charge of changing the mesh bags 39 and 40 as they become filled with golf balls and placing two empty mesh bags in their place.

After dredging the waterhole, the Golf Ball Dredge is floated back onto the trailer if it is convenient to back the trailer into deep enough water (only requiring a few inches). Alternatively, the Dredge can be manually or electrically winched back onto the trailer. If the waterhole is located with a steep bank so that the vehicle towing the trailer cannot be backed down close to the water's edge, an electric winching system is provided for winching the trailer with the boat on it either down the bank or back up the bank from and to the towing vehicle before and after completion of a dredging operation.

COMMERCIAL APPLICABILITY

This invention relates to a relatively small, lightweight (about 1000 pounds) trailerable, pontoon boat golf ball dredge. The golf ball dredge is used in dredging golf balls from ponds, lakes, pools and other similar waterholes located on golf courses and circumvents the need for human divers with or without SCUBA gear manually retrieving valuable golf balls otherwise lost in the waterholes.

Having described one embodiment of a golf ball dredge constructed in accordance with the invention, it is believed obvious that other modifications and variations of the invention will be suggested to those skilled in the art in the light of the above teachings. It is therefore to be understood that changes may be made in the particular embodiment of the invention described which are within the full intended scope of the invention as defined by the appended claims.

What is claimed is:

1. A golf ball dredge comprising a relatively lightweight shallow draft buoyant vessel;

a relatively high pressure water pump supported on the vessel having a suction intake located below the water level and a high pressure outlet discharge;

educator tube means having an inlet end supplied from the high pressure outlet discharge of the high pressure water pump and having a discharge end;

a suction intake piping system having an inlet with the inlet end submerged below the surface of the water to a suitable depth for lightly contacting the bottom of the water;

said educator tube means having its discharge end connected to the suction intake piping system near the inlet end thereof for producing a suction action that draws water and any entrained solids therein into the suction intake piping system and discharges it out the discharge end thereof under increased pressure due to educator action produced by the high pressure liquid discharge supplied from the pump;

automatically operable golf ball separator means supported on the vessel and having the discharge end of the suction intake piping system connected thereto for automatically separating out golf balls from the liquid and other entrained solids contained in the suction intake pipe discharge without the need for human intervention in the separating procedure;

said golf ball separator means comprising golf ball passageway means for increasing or at least maintaining the velocity of golf balls sucked up from the bottom by the suction intake piping system and discharged into the automatically operable golf ball separator means;

golf ball differentiating means coacting with said golf ball passageway means for separating out golf balls from other entrained solids; and golf ball collection and containing means coupled to the output from the golf ball differentiating means for collecting and containing golf balls separated out from other entrained solids by said golf ball differentiating means.

2. A golf ball dredge according to claim 1 further including propulsion and steering means for moving and steering the vessel through the water.

3. A golf ball dredge according to claim 2 wherein the shallow draft buoyant vessel comprises a relatively lightweight pontoon boat having a platform surface thereon for supporting an operator and propulsion and steering means together with the high pressure water pump, the eductor tube means, the suction intake piping system and the golf ball separator means.

4. A golf ball dredge according to claim 3 wherein the propulsion means of the vessel comprises an outboard motor mounted near the bow of the pontoon boat with the inlet end of the suction intake piping system trailing aft from the stern of the boat as it moves through the water, the bulk of the suction intake piping system being comprised by fixed ducting physically mounted between the pontoons of the boat and extending from the inlet end thereof at the stern forward to the bow where it terminates at the intake to the golf ball separator means.

5. A golf ball dredge according to claim 4 wherein the golf ball passageway means comprises an elongated cylindrical tube about 6 inches in diameter that runs along each side of the boat substantially its full length, said elongated cylindrical tubes having a slotted opening forming said golf ball differentiating means along the lower side thereof closest to the water surface which is less than the cross-sectional dimension of a golf ball and said golf ball collecting and containing means is a container secured over the open end of said elongated cylindrical tube for catching and retaining golf balls.

6. A golf ball dredge according to claim 5 wherein the inlet end of the suction intake piping system includes an enlarged, relatively flat suction nozzle secured to the inlet end of the suction intake piping system.

7. A golf ball dredge according to claim 6 wherein the enlarged, relatively flat suction nozzle is a flat, relatively large triangular-shaped baffled chamber having an array of openings on a surface thereof designed to be dragged over a soft mud bottom of a lake, pond, pool or other like body of water where golf balls are collected.

8. A golf ball dredge according to claim 6 wherein the enlarged, relatively flat suction nozzle has a flat, relatively short triangular configuration with openings on an end surface thereof with relatively short flexible hollow tubes secured in the openings in the manner of fingers which can be drawn across the bottom surface of a lake, pond, pool or other like body of water having a sand or rocky bottom or a muddy bottom with stumps and other obstacles therein.

9. A golf ball dredge according to claim 6 wherein the elongated cylindrical tubes run at a slightly downwardly sloping angle relative to the water surface from the bow to the stern of the vessel.

10. A golf ball dredge according to claim 6 wherein the suction intake piping system includes an enlarged, relatively flat, nozzle-like suction pick-up head that may have a variety of physical configurations designed specifically for use with different types of bottom surfaces of a body of water on which the dredge is being used.

11. A golf ball dredge acccording to claim 5 wherein the elongated cylindrical tubes run at a slightly downwardly sloping angle relative to the water surface from the bow to the stern of the vessel.

12. A golf ball dredge according to claim 5 wherein the suction intake piping system includes a removable flexible tube portion that can be removed and replaced with interchangeable different lengths of tubes for adapting the golf ball dredge for use in different depths of water.

13. A golf ball dredge according to claim 1 wherein the golf ball passageway means comprises at least one elongated cylindrical tube that runs substantially the full length of the vessel, said golf ball differentiating means comprising a slotted opening along the lower side of said elongated cylindrical tube closest to the water surface which is less than the cross-sectional dimension of a golf ball and said golf ball collection and containing means is a container secured over the open aft end of said elongated cylindrical tube for catching and retaining golf balls.

14. A golf ball dredge according to claim 13 wherein the elongated cylindrical tube runs at a slightly downwardly sloping angle relative to the water surface from the bow to the stern of the vessel.

15. A golf ball dredge according to claim 1 wherein the inlet end of the suction intake piping system includes an enlarged, relatively flat suction nozzle secured to the inlet end of the suction intake piping system.

16. A golf ball dredge according to claim 15 wherein the enlarged, relatively flat suction nozzle is a flat, relatively large triangular-shaped baffled chamber having an array of openings on a surface thereof designed to be dragged over a soft mud bottom of a lake, pond, pool or other like body of water where golf balls are collected.

17. A golf ball dredge according to claim 15 wherein the enlarged, relatively flat suction nozzle has a flat, relatively short triangular configuration with openings on an end surface thereof with relatively short flexible hollow tubes secured in the openings in the manner of fingers which can be drawn across the bottom surface of a lake, pond, pool or other like body of water having a sand or rocky bottom or a muddy bottom with stumps and other obstacles therein.

18. A golf ball dredge according to claim 15 wherein the suction intake piping system includes an enlarged, relatively flat, nozzle-like suction pick-up head that may have a variety of physical configurations designed specifically for use with different types of bottom surfaces of a body of water on which the dredge is being used.

19. A golf ball dredge according to claim 1 wherein the suction intake piping system includes a removable flexible tube portion that can be removed and replaced with interchangeable different lengths of tubes for adapting the golf ball dredge for use at different depths of water.

20. A golf ball dredge according to claim 1 wherein the suction intake piping system includes an enlarged, relatively flat, nozzle-like suction pick-up head that may have a variety of physical configurations designed specifically for use with different types of bottom surfaces of a body of water on which the dredge is being used.

* * * * *